US009873498B2

(12) United States Patent
Araki et al.

(10) Patent No.: US 9,873,498 B2
(45) Date of Patent: Jan. 23, 2018

(54) STAND-UP TYPE PERSONAL WATERCRAFT

(71) Applicant: Kawasaki Jukogyo Kabushiki Kaisha, Kobe-shi, Hyogo (JP)

(72) Inventors: Toshio Araki, Kakogawa (JP); Hironori Kato, Kakogawa (JP); Masaki Yoshinaka, Kakogawa (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 0 days.

(21) Appl. No.: 14/983,921

(22) Filed: Dec. 30, 2015

(65) Prior Publication Data

US 2017/0190407 A1 Jul. 6, 2017

(51) Int. Cl.

| | |
|---|---|
| ***B63B 35/73*** | (2006.01) |
| ***B63H 21/36*** | (2006.01) |
| ***B63H 21/00*** | (2006.01) |
| *B63B 19/14* | (2006.01) |

(52) U.S. Cl.

CPC ..... *B63H 21/36* (2013.01); *B63B 35/731* (2013.01); *B63H 21/24* (2013.01); *B63B 19/14* (2013.01)

(58) Field of Classification Search

CPC ..... B63B 35/731; B63B 19/12; B63B 19/14

USPC ..... 114/55.56

See application file for complete search history.

(56) References Cited

U.S. PATENT DOCUMENTS 7,343,869 B2 3/2008 Futaki
7,357,090 B2 * 4/2008 Spade ..... B63B 35/731 114/55.52

* cited by examiner

*Primary Examiner* — Andrew Polay

(74) *Attorney, Agent, or Firm* — Alleman Hall Creasman & Tuttle LLP

(57) ABSTRACT

A stand-up type personal watercraft comprises: a body including a hull and a deck; a standing deck provided in a rear portion of the deck; an engine hood attached to the deck and located in front of the standing deck; a pole storage section formed as a recess on an outer upper surface of the engine hood and extending in a forward and rearward direction; a handle pole which is rotatably attached at a front end portion thereof to the deck, and is pivotable between a stowed position at which the handle pole is stowed in the pole storage section, and an up position at which a rear end portion of the handle pole is placed above and away from the pole storage section; and a storage provided in the engine hood by depressing a portion of an upper surface of the pole storage section.

8 Claims, 4 Drawing Sheets

STAND-UP TYPE PERSONAL WATERCRAFT

BACKGROUND OF THE INVENTION

Field of the Invention

The present invention relates to a stand-up type personal watercraft including a storage.

Description of Related Art

In an exemplary configuration, a personal watercraft includes storage which accommodates therein devices or components for the personal watercraft, such as a fire extinguisher, or a rider's personal belongings. U.S. Pat. No. 7,343,869 B2 discloses a personal watercraft including a storage space which can accommodate therein a seat straddled by the rider. In a state in which the seat is accommodated in the storage space, the rider grips a steering handle extending rearward and steers the personal watercraft in a standing posture in which the rider stands on a floor.

The storage space is formed inside a hatch cover, and is located above an engine and between a steering pole and the floor in a forward and rearward direction. Since the storage space is provided, the steering pole is distant from the rider in the forward and rearward direction. The problem associated with this distance is solved by configuring the steering pole in such a manner that the steering pole is extendable and retractable in the forward and rearward direction. However, a steering structure becomes complex.

SUMMARY OF THE INVENTION

An object of the present invention is to provide a storage in a stand-up type personal watercraft without making a steering structure complex.

According to an aspect of the present invention, a stand-up type personal watercraft comprises a body including a hull and a deck; a standing deck which is provided in a rear portion of the deck and on which a rider stands; an engine hood attached to the deck and located in front of the standing deck; a pole storage section formed as a recess on an outer upper surface of the engine hood and extending in a forward and rearward direction; a handle pole which is rotatably attached at a front end portion thereof to the deck, and is pivotable between a stowed position at which the handle pole is stowed in the pole storage section, and an up position at which a rear end portion of the handle pole is placed above and away from the pole storage section; and a storage provided in the engine hood by depressing a portion of an upper surface of the pole storage section.

In accordance with this configuration, in the stand-up type personal watercraft, the handle pole can be placed in an interior of the pole storage section formed by depressing the outer upper surface of the engine hood, and thus, the structure of a region which is in the vicinity of the handle pole can be simplified. The storage can be formed in the engine hood integrally with the pole storage section. Thus, the storage can be easily manufactured. Since the handle pole is placed in the pole storage section, the storage can be covered by the handle pole from above. Also, the storage can be covered by the pole storage section from the side. Thus, the external appearance of the personal watercraft can be improved.

DETAILED DESCRIPTION OF THE PREFERRED EMBODIMENTS

Hereinafter, the embodiment will be described with reference to the drawings. The stated directions are from the perspective of a rider riding on a personal watercraft 1.

Figure 1:
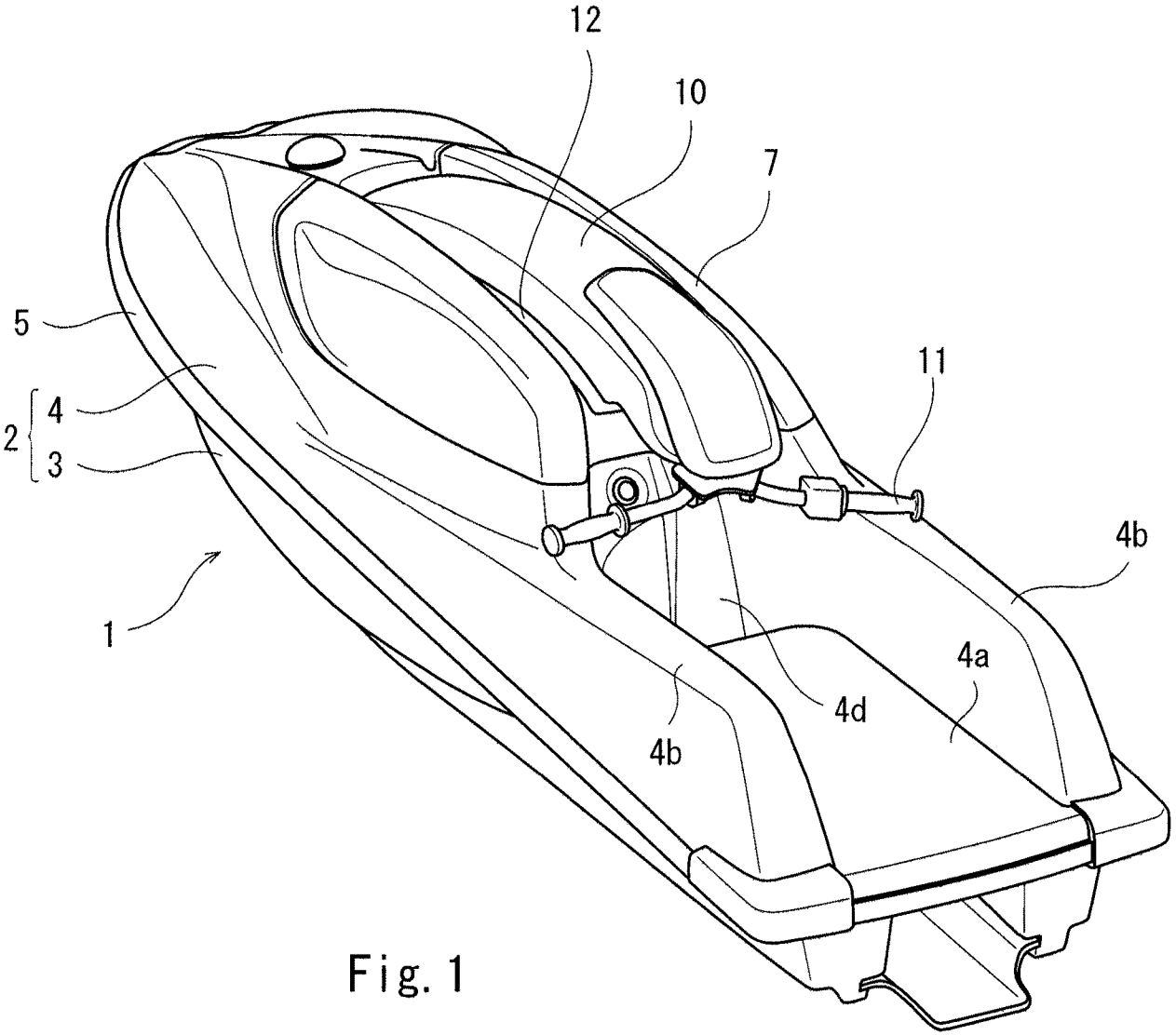
FIG. 1 is a perspective view of a personal watercraft according to an embodiment.
Figure 2:
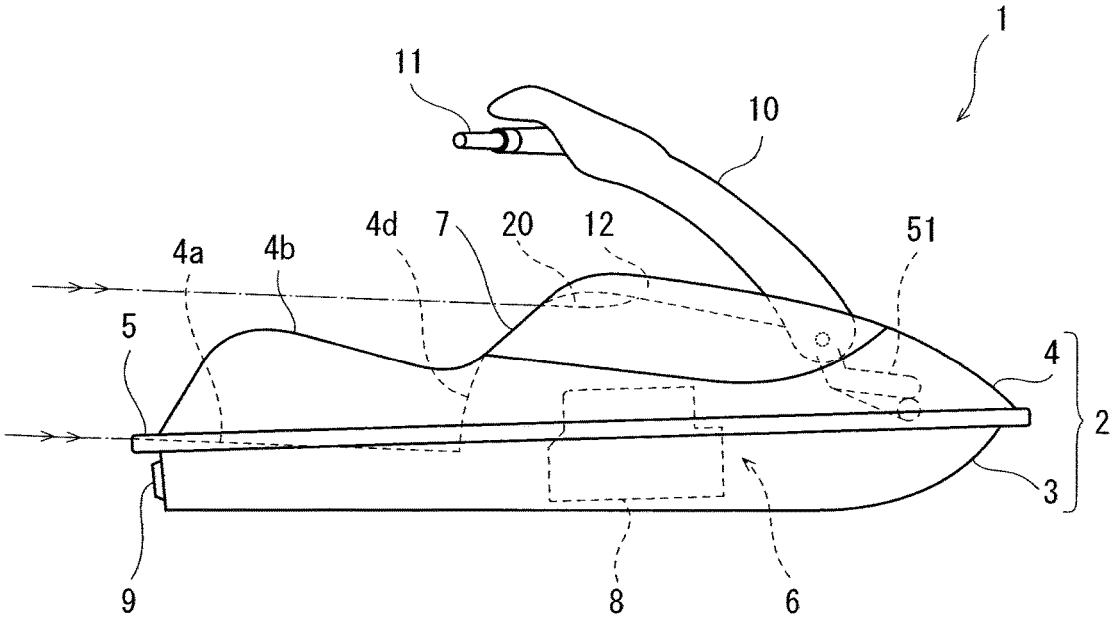
FIG. 2 is a side view of the personal watercraft.
Figure 3:
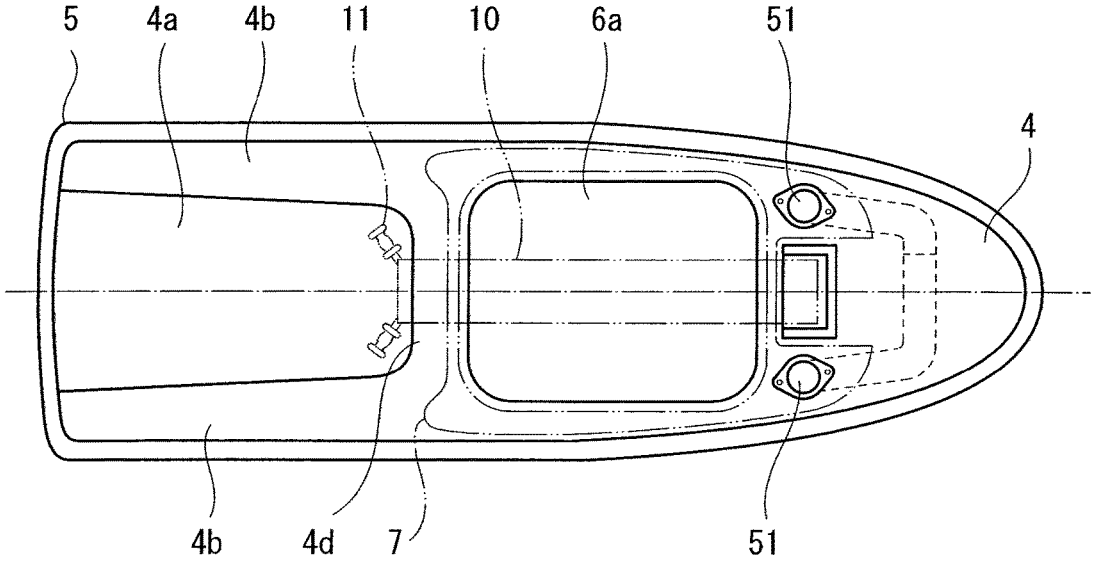
FIG. 3 is a plan view of the personal watercraft.

As shown in FIGS. 1 to 3, the personal watercraft 1 includes a body 2 including a hull 3 and a deck 4. The deck 4 covers the hull 3 from above, and is connected to the hull 3. A connection line of the hull 3 and the deck 4 is in some cases called a gunnel line. An engine room 6 is provided in an interior of the body 2, is in communication with a maintenance opening 6*a* provided in the deck 4, and is opened upward through the maintenance opening 6*a*. An engine hood 7 covers the maintenance opening 6*a* from above, and is detachably attached to the deck 4. An engine 8 is disposed in the engine room 6. A water jet pump (not shown) is driven by the engine 8. The water jet pump pressurizes and accelerates water suctioned through a suction port provided in the hull 3. The pressurized and accelerated water is ejected rearward through a jet nozzle 9 attached to the rear end portion of the body 2. In this way, a forward propulsive force is generated in the body 2.

The personal watercraft 1 is a stand-up type personal watercraft which is steered by the rider in a standing posture. A standing deck 4*a*, and right and left deck fins 4*b* are provided at the rear portion of the deck 4. The standing deck 4*a* is located rearward relative to the engine room 6. The standing deck 4*a* has on the front side thereof, a front wall 4*d* protruding upward and extending in a rightward and leftward direction. The standing deck 4*a* is isolated from the engine room 6 by the front wall 4*d*. The deck fins 4*b* are provided on the right side and the left side of the standing deck 4*a*, respectively, to protrude upward and extend in a forward and rearward direction. The front end portion of the deck fin 4*a* is continuous with the front wall 4*d*. The rear portion of the standing deck 4*a* is not surrounded by the deck fins 4*b* and a wall such as the front wall 4*d* and is opened rearward so that the rider can easily get on and off the personal watercraft 1. The standing deck 4*a* is surrounded by the deck fins 4*b* and the front wall 4*d*, which have a U-shape when viewed from above. When viewed from above, the standing deck 4*a* has a rectangular shape which is symmetric in the rightward and leftward direction with respect to a center line of the body 2 in the rightward and leftward direction.

The front end portion of the handle pole 10 is coupled to the upper surface of the deck 4 in front of the maintenance opening 6*a* in such a manner that handle pole 10 is rotatable around the front end portion. The handle pole 10 is vertically pivotable around the front end portion thereof. A bar-type steering handle 11 is attached on the rear end portion of the handle pole 10. A pole storage section 12 is formed as a recess on the outer upper surface of the engine hood 7 and extends in the forward and rearward direction. The pole storage section 12 extends in the forward and rearward direction in the center portion of the engine hood 7 in the rightward and leftward direction, and is formed like a groove. The handle pole 10 is pivotable between a stowed position at which the handle pole 10 is stowed in the pole storage section 12 and an up position at which the rear end portion of the handle pole 10 is placed above and away from the pole storage section 12. In a state in which the steering handle 11 is not gripped by the rider, the handle pole 10 is in the stowed position and extends substantially horizontally. The rider gets on the standing deck 4*a* from the rear, stands on the standing deck 4*a*, and grips the steering handle 11 to move the handle pole 10 upward. In this way, the handle pole 10 is moved out of the pole storage section 12 and extends rearward such that its rear portion is higher.

Figure 4:
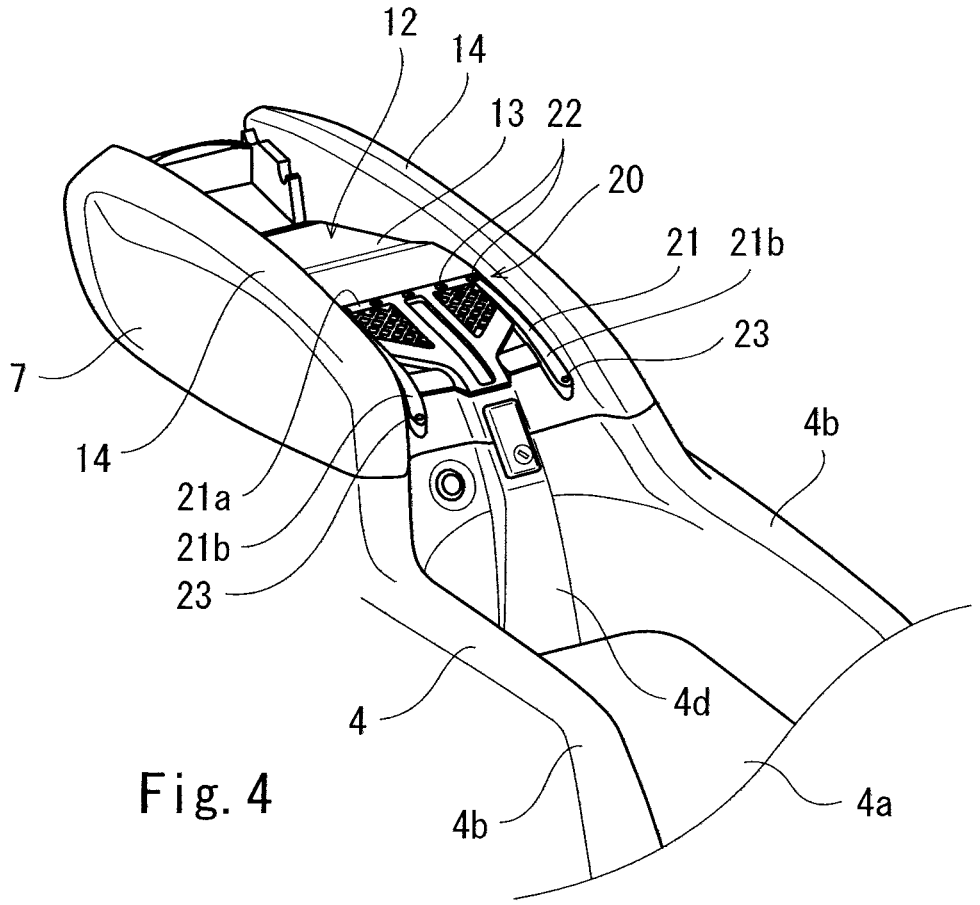
FIG. 4 is a perspective view showing a region which is in the vicinity of an engine hood in a state in which a handle pole is omitted or is placed in a high position.

FIG. 4 is a perspective view showing a region which is in the vicinity of the engine hood 7 in a state in which the handle pole 10 is omitted, when viewed from the rear. FIG. 3 shows the region which is in the vicinity of the engine hood 7 in a state in which the handle pole 10 is moved to the up position. The pole storage section 12 includes a bottom wall 13 extending in the forward and rearward direction, in the center portion of the engine hood 7 in the rightward and leftward direction, and a pair of side walls 14 protruding upward on the right side and the left side of the bottom wall 13, and extending in the forward and rearward direction.

The personal watercraft 1 includes a storage 20 formed in the engine hood 7 by depressing a portion of the upper surface of the bottom wall 13 of the pole storage section 12. As can be seen from FIG. 1, the storage 20 is covered by the handle pole 10 in a state in which the handle pole 10 is in the stowed position, because the storage 20 is provided on the bottom wall 13 of the pole storage section 12. When the handle pole 10 is moved to the up position, the storage 20 is exposed. The storage 20 is located on the rear end portion of the pole storage section 12, and is made to be as close to the standing deck 4*a* as possible. When the rider stands on the standing deck 4*a* and moves the handle pole 10 upward, the rider can easily reach the storage 20. In this way, the storage 20 can be used conveniently by the rider. The storage 20 is openable and closable by a lid 21.

Figure 5:
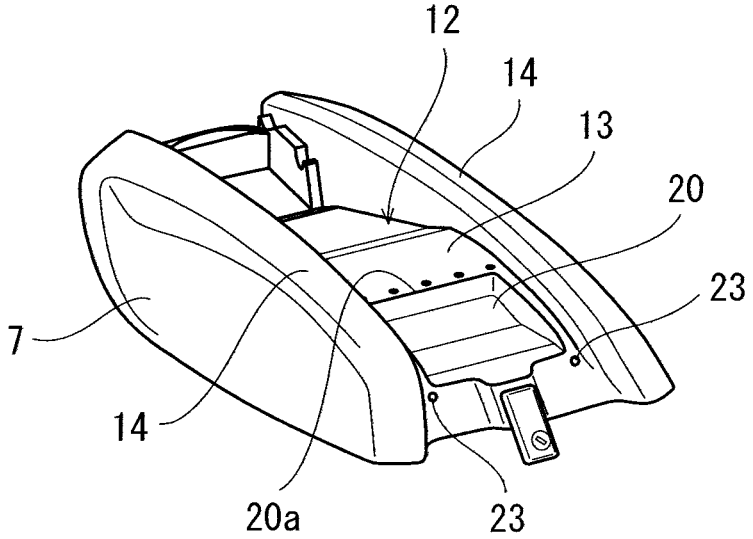
FIG. 5 is a perspective view showing a region which is in the vicinity of the engine hood in a state in which a lid is detached.

FIG. 5 is a perspective view showing a region which is in the vicinity of the engine hood 7 in a state in which the lid 21 is detached. As shown in FIG. 5, an opening 20*a* of the storage 20 is provided on the bottom wall 13 of the pole storage section 12. The lid 21 is attached to the pole storage section 12 to close the opening 20*a*. Because of the lid 21, it becomes possible to prevent loss of items stored in the storage 20 while the personal watercraft 1 is planing on the water.

The lid 21 includes a front lid edge 21*a* fastened to the front edge portion of the opening 20*a* by fastener members such as rivets or bolts, and rear lid edges 21*b* removably fastened to the lower edge portion of the opening 20*a*. The rider standing on the standing deck 4*a* is present rearward relative to the storage 20. Since the rear lid edges 21*b* are removably fastened to the pole storage section 12, an operation for opening and closing the opening 20*a* can be performed easily. For example, a plurality of pins 23 protrude upward from the bottom wall 13 of the pole storage section 12 at the rear edge portion of the opening 20*a*. In the illustrated example, two pins 23 protrude upward from the right and left ends of the rear edge portion of the opening 20*a*. The rear lid edges 21*b* have through-holes 21*c* (see FIG. 6) in locations conforming to the pins 23, respectively. By inserting the pins 23 into the through-holes 21*c*, respectively, the rear lid edges 21*b* can be attached to the pole storage section 12. When the pins 23 are disengaged from the through-holes 21*c*, respectively, the lid 21 can be moved upward and thus the opening 20*a* can be exposed.

The lid 21 has a sheet shape and is made of rubber. This allows the rider to easily open and close the lid 21. In the above-described configuration, the lid 21 can be easily moved upward. In addition, even when the items stored in the storage 20 exceeds the capacity of the storage 20, the lid 21 is elastically deformed to maintain the state in which the opening 20*a* is closed. In the state in which the opening 20*a* of the storage 20 is closed by the lid 21, the upper surface of the lid 21 is substantially coplanar with the upper surface of the bottom wall of the pole storage section 12. In this configuration, when the handle pole 10 is in the stowed position, the handle pole 10 can be stably accommodated in the pole storage section 12 of the groove shape without forming a substantial clearance between the handle pole 10 and the bottom wall of the pole storage section 12.

The lid 21 is formed with a mesh. In the state in which the opening 20*a* of the storage 20 is closed by the lid 21, a gap may be formed between the lid 21 and the pole storage section 12. In other words, the storage 20 may not have a water-proof property. Therefore, the rider can temporarily store the items which are not significantly damaged by water in the storage 20 and take the items out of the storage 20, with a simple operation. As examples of such items, there are a glove, a key, etc.

In the case where the storage 20 does not have the water-proof property as described above, the water surrounding the personal watercraft 1 may enter the storage 20. However, even when the water enters the storage 20, the water can be easily drained.

As shown in FIG. 2, the rear end portion of the bottom wall of the storage 20 extends in parallel with the standing deck 4*a*. During use of the personal watercraft 1, the entry of the water into the standing deck 4*a* is unavoidable. In most cases, after a user of the personal watercraft 1 finishes planing on the water and moves the personal watercraft 1 out of the water onto the ground, the user tilts the body 2 in such a manner that the rear portion of the standing deck 4*a* is lower than the front portion of the standing deck 4*a*, to drain the water from the standing deck 4*a*. In this way, drying of the standing deck 4*a* is facilitated. Since the rear end portion of the bottom wall of the storage 20 is parallel to the standing deck 4*a*, the water accumulated in the storage 20 can be drained together with the water drained from the standing deck 4*a* in the above-described manner. The water drained from the storage 20 travels to the standing deck 4*a* through the pole storage section 12, and is drained from the standing deck 4*a*. Thus, the rider need not perform an operation specifically for draining the water from the storage 20. This is advantageous to the storage 20 which does not have the water-proof property.

Figure 6:
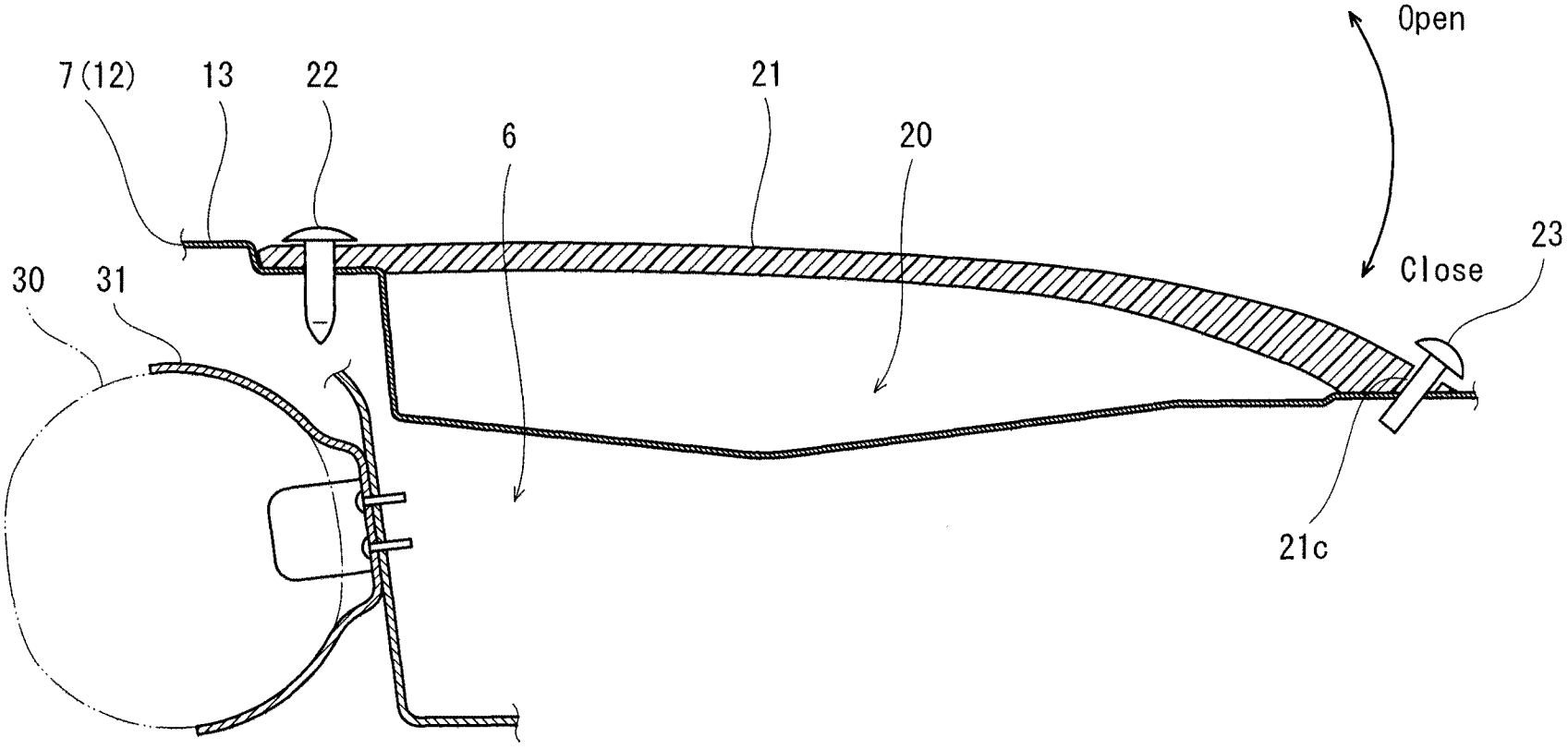
FIG. 6 is a cross-sectional view of a storage.

With reference to FIG. 6, the personal watercraft 1 is provided with spaces in which the rider's belongings or the devices and components for the personal watercraft 1 are accommodated. For example, a fire extinguisher holder 31 for holding a fire extinguisher 30 inside the engine hood 7 is provided in the interior of the engine hood 7. The storage 20 is placed rearward relative to the fire extinguisher holder 31 and close to the rider. The storage 20 is provided separately from the space in which the device such as the fire extinguisher 30 is accommodated. Thus, the rider can use the storage 20 conveniently.

The storage 20 is formed by depressing a portion of the bottom wall 13 of the pole storage section 12 formed as the recess on the engine hood 7. In the present embodiment, the inner space of the engine hood 7 is made to be wide. In this configuration, it becomes possible to easily integrate the storage 20 with the engine hood 7 by depressing a portion of the pole storage section 12, without reducing the inner space of the engine hood 7.

Turning back to FIGS. 2 and 3, the engine room 6 is formed in the interior of the body 2 by covering the maintenance opening 6*a* by the engine hood 7. The engine 8 is placed below the maintenance opening 6*a* in the interior of the engine room 6. The personal watercraft 1 includes at least one ventilation duct 51 which is attached to the deck 4 in a location different from the maintenance opening 6*a*, and guides outside air to the engine room 6. The engine hood 7 covers the maintenance opening 6*a* and the inlet of the ventilation duct 51. Typically, the ventilation duct 51 is provided on the engine hood 7. In the present embodiment, however, the ventilation duct 51 is attached to the deck 4 instead of the engine hood 7 (see broken line of FIG. 2). This can provide a space for the storage 20, in the rear portion of the engine hood 7. In this way, the storage 20 can be positioned to be easily accessible to the rider.

The present embodiment is not limited to the above-described embodiment, and may be changed, added to, or deleted from, within a scope of the spirit of the present invention.

The invention claimed is:

1. A stand-up type personal watercraft comprising:

a body including a hull and a deck;

a standing deck which is provided in a rear portion of the deck and is configured to allow a rider to stand;

an engine hood attached to the deck and located in front of the standing deck;

a pole storage section formed as a recess on an outer upper surface of the engine hood and extending in a forward and rearward direction;

a handle pole which is rotatably attached at a front end portion thereof to the deck, and is pivotable between a stowed position at which the handle pole is stowed in the pole storage section, and an up position at which a rear end portion of the handle pole is placed above and away from the pole storage section;

a storage compartment provided in the engine hood by depressing a portion of an upper surface of the pole storage section; and a lid configured to open and close the storage compartment when the handle pole is in the up position.

2. The stand-up type personal watercraft according to claim 1, wherein the storage compartment is provided in a rear end portion of the upper surface of the pole storage section.

3. A stand-up type personal watercraft comprising:

a body including a hull and a deck;

a standing deck which is provided in a rear portion of the deck and is configured to allow a rider to stand;

an engine hood attached to the deck and located in front of the standing deck;

a pole storage section formed as a recess on an outer upper surface of the engine hood and extending in a forward and rearward direction;

a handle pole which is rotatably attached at a front end portion thereof to the deck, and is pivotable between a stowed position at which the handle pole is stowed in the pole storage section, and an up position at which a rear end portion of the handle pole is placed above and away from the pole storage section; and a storage compartment provided in the engine hood by depressing a portion of an upper surface of the pole storage section, wherein a bottom surface of at least a rear end portion of the storage compartment is substantially parallel to an upper surface of the standing deck.

4. A stand-up type personal watercraft comprising:

a body including a hull and a deck;

a standing deck which is provided in a rear portion of the deck and is configured to allow a rider to stand;

an engine hood attached to the deck and located in front of the standing deck;

a pole storage section formed as a recess on an outer upper surface of the engine hood and extending in a forward and rearward direction;

a handle pole which is rotatably attached at a front end portion thereof to the deck, and is pivotable between a stowed position at which the handle pole is stowed in the pole storage section, and an up position at which a rear end portion of the handle pole is placed above and away from the pole storage section;

a storage compartment provided in the engine hood by depressing a portion of an upper surface of the pole storage section; and a lid which is attached to the pole storage section and opens and closes the storage compartment, wherein in a state in which the storage compartment is closed by the lid, the lid is substantially coplanar with the pole storage section.

5. The stand-up type personal watercraft according to claim 4, wherein the lid is made of rubber having an elasticity.

6. The stand-up type personal watercraft according to claim 4, wherein the lid is formed with a mesh, or a gap is formed between the lid and the pole storage section in a state in which the storage compartment is closed by the lid.

7. The stand-up type personal watercraft according to claim 1, further comprising:

a fire extinguisher holder placed in an interior of the engine hood to hold a fire extinguisher in the interior of the engine hood, wherein the storage compartment is placed rearward relative to the fire extinguisher holder.

8. The stand-up type personal watercraft according to claim 1, further comprising:

an engine placed in an engine room formed in an interior of the body;

a maintenance opening which is provided in the deck, is located above the engine, and is in communication with the engine room; and at least one ventilation duct which is attached to the deck in a location different from the maintenance opening and guides outside air to the engine room, wherein the engine hood covers the maintenance opening and an inlet of the ventilation duct.

* * * * *